US012716581B2

(12) United States Patent
Weilert et al.

(10) Patent No.: US 12,716,581 B2
(45) **Date of Patent: *Aug. 25, 2026**

(54) COMBUSTIBLE FUEL BURNING STOVE WITH PELLET ADAPTER

(71) Applicant: SOLO BRANDS, LLC, Grapevine, TX (US)

(72) Inventors: Jeffrey R. Weilert, Southlake, TX (US); Alexander K. Maghsadi, Lewisville, TX (US)

(73) Assignee: Solo Brands, LLC, Grapevine, TX (US)

( * ) Notice: Subject to any disclaimer, the term of this patent is extended or adjusted under 35 U.S.C. 154(b) by 356 days.

This patent is subject to a terminal disclaimer.

(21) Appl. No.: 18/458,969

(22) Filed: Aug. 30, 2023

(65) Prior Publication Data

US 2024/0068658 A1 Feb. 29, 2024

Related U.S. Application Data

(63) Continuation of application No. 17/899,937, filed on Aug. 31, 2022, now Pat. No. 11,774,089.

(51) Int. Cl.
*F23B 30/00* (2006.01)
*F23B 20/00* (2006.01)
(Continued)

(52) U.S. Cl.
CPC ..... *F23B 1/26* (2013.01); *F23B 1/18* (2013.01); *F23B 1/28* (2013.01); *F23B 1/38* (2013.01);
(Continued)

(58) Field of Classification Search
CPC .... F23B 1/18; F23B 60/02; F23B 1/28; F23B 20/00; F23B 1/26; F23B 1/38; F23L 9/02;
(Continued)

(56) References Cited

U.S. PATENT DOCUMENTS 560,274 A 5/1896 Moon
564,864 A 7/1896 Bonnet
(Continued)

FOREIGN PATENT DOCUMENTS

CA 3056244 A1 3/2020
CN 2035756 U 4/1989
(Continued)

OTHER PUBLICATIONS

Solo Stove, webpage capture: https:/www.solostove.com/solo-stove-bonfire, 2017, 8 pages.
(Continued)

*Primary Examiner* — Alfred Basichas
(74) *Attorney, Agent, or Firm* — Haynes and Boone, LLP

(57) ABSTRACT

A stove includes a combustion chamber, a fuel grate positioned within the combustion chamber, and a pellet adapter removably positionable on the fuel grate. The fuel grate includes a number of first ventilation holes. The pellet adapter includes a number of second ventilation holes sized and shaped to prevent passage of a fuel pellet. The pellet adapter also includes a raised outer rim and a central protuberance with a height greater than the height of the raised outer rim.

22 Claims, 13 Drawing Sheets

(51) Int. Cl.

| | |
|---|---|
| ***F23B 60/02*** | (2006.01) |
| ***F24B 1/02*** | (2006.01) |
| ***F24B 1/193*** | (2006.01) |
| *F24B 1/18* | (2006.01) |
| *F24B 1/181* | (2006.01) |
| *F24B 3/00* | (2006.01) |
| *F24B 13/02* | (2006.01) |

(52) U.S. Cl.
CPC ..... *F23B 20/00* (2013.01); *F23B 60/02* (2013.01); *F24B 1/02* (2013.01); *F24B 1/193* (2013.01); *F23H 2700/006* (2013.01); *F24B 1/18* (2013.01); *F24B 1/181* (2013.01); *F24B 3/00* (2013.01); *F24B 13/02* (2013.01)

(58) Field of Classification Search
CPC .. F24B 1/02; F24B 1/193; F24B 5/026; F24B 1/18; F24B 1/181; F24B 3/00; F24B 13/02; F23H 2700/006
See application file for complete search history.

(56) References Cited

U.S. PATENT DOCUMENTS

| | | | |
|---|---|---|---|
| 685,194 | A | 10/1901 | Young |
| 904,188 | A | 11/1908 | Engle |
| 1,298,762 | A | 4/1919 | Milligan |
| 1,310,327 | A | 7/1919 | Dutton |
| 1,465,442 | A | 8/1923 | Jones |
| 1,694,175 | A | 12/1928 | Hauser |
| D100,012 | S | 6/1936 | Ford |
| 2,346,586 | A | 4/1944 | Keown |
| 2,614,553 | A | 10/1952 | Cox |
| 2,722,883 | A | 11/1955 | Rignell |
| 2,738,225 | A | 3/1956 | Meek |
| D196,018 | S | 8/1963 | Palmer |
| 3,756,218 | A | 9/1973 | Simpson |
| D229,013 | S | 11/1973 | Storandt |
| D229,277 | S | 11/1973 | Chan |
| 3,790,081 | A | 2/1974 | Thornton |
| 3,937,138 | A | 2/1976 | Tidwell |
| 3,951,082 | A | 4/1976 | Leggett |
| D258,259 | S | 2/1981 | Lindholm |
| D258,712 | S | 3/1981 | Jacobson |
| D273,264 | S | 4/1984 | Elliston |
| 4,735,135 | A | 4/1988 | Walker |
| 4,903,683 | A | 2/1990 | Larsen |
| 5,024,208 | A | 6/1991 | Hottenroth |
| 5,117,558 | A | 6/1992 | Hull |
| D355,809 | S | 2/1995 | Kothrade |
| D358,204 | S | 5/1995 | Ferrier |
| 5,490,452 | A | 2/1996 | Schlosser |
| D379,900 | S | 6/1997 | Gillam et al. |
| 5,638,808 | A | 6/1997 | Home |
| 5,651,356 | A | 7/1997 | Kaines |
| 5,797,386 | A | 8/1998 | Orr |
| 5,809,988 | A | 9/1998 | Wagner |
| 6,024,081 | A | 2/2000 | Libertini, Jr. |
| D422,452 | S | 4/2000 | Persson |
| D435,191 | S | 12/2000 | Cooper |
| 6,196,121 | B1 | 3/2001 | Crowl |
| 6,196,215 | B1 | 3/2001 | Chandaria |
| D442,422 | S | 5/2001 | Dabney |
| D444,991 | S | 7/2001 | Measom |
| 6,314,955 | B1 | 11/2001 | Boetcker |
| 6,393,717 | B1 | 5/2002 | Santos |
| 6,488,023 | B2 | 12/2002 | Pecoskie |
| D488,023 | S | 4/2004 | Siegel et al. |
| D491,409 | S | 6/2004 | Siegel |
| D495,552 | S | 9/2004 | Siegel |
| D531,849 | S | 11/2006 | Turner |
| D534,756 | S | 1/2007 | Jensen |
| D549,300 | S | 8/2007 | Harrell |
| D607,265 | S | 1/2010 | Gaunaurd, III |
| D612,191 | S | 3/2010 | Taber |
| D612,662 | S | 3/2010 | Lorenz |
| D618,038 | S | 6/2010 | Davies |
| 7,810,484 | B2 | 10/2010 | Schlosser |
| D644,474 | S | 9/2011 | Wilgus |
| 8,087,410 | B2 | 1/2012 | Gregory |
| D658,426 | S | 5/2012 | Saunders |
| D683,999 | S | 6/2013 | Karlsson |
| 8,511,295 | B2 | 8/2013 | Buerkle |
| D701,721 | S | 4/2014 | Jan |
| 8,991,382 | B1 | 3/2015 | Mau |
| D749,960 | S | 2/2016 | Bhattacharyya et al. |
| 9,844,300 | B2 | 12/2017 | Cedar |
| 10,098,502 | B2 | 10/2018 | Ohler |
| 10,125,995 | B2 | 11/2018 | Kohli |
| 10,222,092 | B1 | 3/2019 | Traeger |
| D858,729 | S | 9/2019 | Scott |
| 10,982,880 | B1 | 4/2021 | Traeger |
| D923,163 | S | 6/2021 | Jan |
| 11,092,342 | B2 | 8/2021 | Harrington |
| 11,293,642 | B2 | 4/2022 | Jan |
| 11,378,279 | B2 | 7/2022 | Jan |
| 11,774,089 | B1 * | 10/2023 | Weilert ..... F23L 9/02 126/540 |
| 2004/0255930 | A1 | 12/2004 | Klemming |
| 2006/0219233 | A1 | 10/2006 | Sorenson |
| 2007/0137634 | A1 | 6/2007 | Traeger |
| 2009/0165772 | A1 | 7/2009 | Hunt |
| 2010/0043775 | A1 | 2/2010 | Phillips |
| 2011/0180527 | A1 | 7/2011 | Abbott |
| 2012/0017884 | A1 | 1/2012 | Van Den Hoff |
| 2014/0007778 | A1 | 1/2014 | Marks |
| 2014/0026765 | A1 | 1/2014 | Fou |
| 2014/0165993 | A1 | 6/2014 | Ahmed |
| 2014/0238378 | A1 | 8/2014 | Scott |
| 2015/0068512 | A1 | 3/2015 | Mehler |
| 2015/0083108 | A1 | 3/2015 | DeFoort et al. |
| 2015/0110939 | A1 | 4/2015 | Benson |
| 2015/0211743 | A1 | 7/2015 | Defoort |
| 2017/0363325 | A1 | 12/2017 | Diurlin |
| 2019/0313851 | A1 | 10/2019 | Shemp |
| 2020/0096199 | A1 | 3/2020 | Harrington |
| 2020/0224879 | A1 | 7/2020 | Scott |
| 2020/0309369 | A1 | 10/2020 | Jan |
| 2021/0018180 | A1 | 1/2021 | Jan |
| 2021/0048188 | A1 | 2/2021 | Harrington |
| 2021/0199301 | A1 | 7/2021 | Poggi |
| 2021/0274970 | A1 | 9/2021 | Stoltzfus |
| 2021/0282592 | A1 | 9/2021 | Jan |
| 2022/0390118 | A1 | 12/2022 | Suess |

FOREIGN PATENT DOCUMENTS

| | | | |
|---|---|---|---|
| CN | 301861920 | | 3/2012 |
| CN | 307391993 | | 6/2022 |
| EM | 009019185-00001 | | 6/2022 |
| JP | H10323289 | A | 12/1998 |
| JP | 2000342462 | A | 12/2000 |
| JP | 2003190011 | A | 7/2003 |
| KR | 200295935 | Y1 | 11/2002 |
| KR | 200349281 | Y1 | 5/2004 |
| KR | 100898493 | B1 | 5/2009 |
| KR | 20190068335 | A | 6/2019 |
| KR | 20200122766 | A | 10/2020 |
| WO | 2017078762 | A1 | 5/2017 |

OTHER PUBLICATIONS

International Search Authority, International Search Report and Written Opinion, PCT/US2021/020687, dated Aug. 5, 2021, 11 pages.

International Search Authority, International Search Report and Written Opinion, ISA/KR, PCT/US2019/063180, dated Mar. 26, 2020, 10 pages.

Screen captures from YouTube video clip entitled "Solo Stove Bonfire: Best Gear of2017," 4 pages, uploaded on May 14, 2017 by user "Canadian Prepper". Retrieved from Internet: https://www.youtube.corn/watch?v• Vo_J_flWq5g.

(56) References Cited

OTHER PUBLICATIONS

Camping stove, https://www.kickstarter.com/projects/3406722 I 8/solo-stove-campfire-backpack-camp-survive/description, 4 pages (2014).
Korean Intellectual Property Office, International Search Report and Written Opinion, PCT/US2022/011365, May 3, 2022, 12 pages.
Intellectual Property Office of Vietnam, Office Opinion for Vietnam Application No. 3-2023-00248, mailed Aug. 16, 2024, 3 pages.

* cited by examiner

COMBUSTIBLE FUEL BURNING STOVE WITH PELLET ADAPTER

CROSS REFERENCE TO RELATED APPLICATIONS

This application is a continuation of patent application Ser. No. 17/899,937, filed Aug. 31, 2022, entitled COMBUSTIBLE FUEL BURNING STOVE WITH PELLET ADAPTER, which is hereby incorporated by reference in its entirety as though fully set forth herein. This application is also related to U.S. Design patent application No. 29/866,179, filed Aug. 31, 2022, titled Device For A Fire Pit, and to U.S. Design patent application No. 29/866,181, filed Aug. 31, 2022, titled Device For A Fire Pit, both of which are hereby incorporated by reference in their entirety as though fully set forth herein.

TECHNICAL FIELD

The subject matter described herein relates to a combustible fuel burning stove, such as a fire pit, with an adapter for burning biomass pellets.

BACKGROUND

Portable wood burning stoves, such as fire pits, are used in camping, and make use of twigs and sticks as fuel for heat and cooking. Similarly, large portable fire pits are used for example in residential back yards for recreation, to provide outdoor heat, and to support limited cooking such as marshmallow roasting.

However, portable wood-burning stoves, including portable fire pits, are generally fueled by piles of sticks or logs (e.g., firewood) supported by a fuel grate. The fuel grate includes structural features sufficient to support the load of fuel, which may in some cases be quite heavy, at operating temperatures of between about 700° F. (371° C.) and about 1350° F. (732° C.). In addition, the fuel grate is generally designed not warp or deform when thermally cycled between these high operating temperatures and much lower ambient temperatures of between about 100° F. (38° C.) and −40° F. (−40° C.). However, in order to provide sufficient airflow for combustion, the fuel grate will typically have ventilation holes that are large and/or numerous.

Wood pellets may in some cases be considered to have advantages over firewood. Pellets are easily stored in sacks or barrels, have a high energy density, and may combust more slowly than firewood, thus providing a more uniform heat, light, and ambience from the stove over a longer period of time. However, the design features of fuel grates may be problematic for users who may want to burn smaller fuel sources such as wood pellets, which may tend to fall through the ventilation openings of the fuel grate. In addition, because wood pellets may pile more densely than sticks and logs, with less airflow space between the pellets, a pile of wood pellets may tend to burn from the top down, rather than from the bottom up. Thus, the shape of a flat or dome-shaped fuel grate may not encourage uniform, smoke-free combustion of wood pellets, as well as other small fuel items such as paper pellets, wood chips, etc.

It is therefore to be appreciated that such commonly used fuel grates have numerous drawbacks, including one or more of large ventilation holes, smoke generation, and otherwise. Accordingly, long-felt needs exist for fire pit and portable wood-burning stove structures that address the forgoing and other concerns.

The information included in this Background section of the specification, including any references cited herein and any description or discussion thereof, is included for technical reference purposes only and is not to be regarded as subject matter by which the scope of the disclosure is to be bound.

SUMMARY

Disclosed is a pellet adapter for a wood burning fire pit style stove. The pellet adapter includes novel structural features to allow the pellet adapter to fit on top of a fuel grate within the body of the stove. The pellet adapter includes features that prevent wood pellets from falling through ventilation openings in the fuel grate, and that also provide for even distribution and combustion of the pellets. The pellet adapter has particular but not exclusive utility for allowing wood-burning fire pits and camp stoves to burn pelletized fuels instead.

One general aspect includes a combustion fire pit style stove. The stove includes a combustion chamber; a fuel grate positioned within the combustion chamber, the fuel grate including a plurality of first ventilation holes; a pellet adapter removably positionable on the fuel grate within the combustion chamber, the pellet adapter including: a pellet tray including a plurality of second ventilation holes sized and shaped to prevent passage of a fuel pellet; a raised outer rim; and a central protuberance with a height greater than the height of the raised outer rim.

Implementations may include one or more of the following features. In some embodiments, the pellet adapter further includes a plurality of indentations. In some embodiments, the pellet tray includes a handle grippable by a user. In some embodiments, the indentations include feet that contact the fuel grate when the pellet adapter is positioned on the fuel grate within the combustion chamber. In some embodiments, when the pellet adapter is positioned on the fuel grate within the combustion chamber, a bottom edge of the raised outer rim contacts the fuel grate. In some embodiments, the central protuberance includes a lower portion fixedly attached to the pellet tray and an upper portion removably attached to the lower portion. In some embodiments, the central protuberance includes a plurality of third ventilation holes sized and shaped to prevent passage of the fuel pellet. In some embodiments, the central protuberance includes a truncated cone. In some embodiments, the pellet tray includes a truncated cone. In some embodiments, the raised outer rim includes a plurality of fourth ventilation holes sized and shaped to prevent passage of the fuel pellet. In some embodiments, when the pellet adapter is positioned on the fuel grate within the combustion chamber, an air gap exists between the raised outer rim and an inner wall of the combustion chamber.

One general aspect includes a pellet adapter for adapting a wood burning stove to a pellet burning stove. The pellet adapter includes a pellet tray including a plurality of ventilation holes sized and shaped to prevent passage of a fuel pellet; a raised outer rim; and a central protuberance with a height greater than the height of the raised outer rim, where the pellet adapter is removably positionable on a fuel grate of a stove within a combustion chamber of the stove.

Implementations may include one or more of the following features. In some embodiments, the pellet adapter where the pellet adapter further includes a plurality of indentations formed in the pellet tray. In some embodiments, the indentations include feet that contact the fuel grate when the pellet adapter is positioned on the fuel grate within the combustion chamber. In some embodiments, the central protuberance includes a lower portion fixedly attached to the pellet tray and an upper portion removably attached to the lower portion. In some embodiments, at least one of the central protuberance or the raised outer rim includes a plurality of third ventilation holes sized and shaped to prevent passage of the fuel pellet. In some embodiments, the central protuberance includes a truncated cone. In some embodiments, the pellet tray includes a truncated cone. In some embodiments, when the pellet adapter is positioned on the fuel grate within the combustion chamber, an air gap exists between the raised outer rim and an inner wall of the combustion chamber, and a bottom edge of the raised outer rim contacts the fuel grate.

One general aspect includes a stove for burning pelletized fuel to produce heat. The stove includes an inner wall having a lower portion and an upper portion; an outer wall having a lower portion and an upper portion; an air-filled space between the inner wall and outer wall; a chimney formed by the inner wall; a combustion area situated within the chimney; at least one ventilation hole within the upper portion of the inner wall; at least one ventilation hole within the lower portion of the outer wall; a fuel grate situated within the combustion area, including a plurality of first ventilation holes; and a pellet adapter removably positionable on the fuel grate within the combustion area, the pellet adapter including: a pellet tray including a plurality of second ventilation holes sized and shaped to prevent passage of the pelletized fuel; a raised outer rim; and a central protuberance with a height greater than the height of the raised outer rim.

In yet other implementations, this disclosure is directed to a pellet adapter for adapting a log or stick burning stove to a pellet burning stove. The log or stick burning stove may include a combustion chamber with a fuel grate therein. The fuel grate may have holes configured to pass air or ash therethrough, the holes having a first width that does not inhibit or prevent passage of a fuel pellet. The pellet adapter may include a pellet tray comprising a plurality of ventilation holes having a second width smaller than the first width, the second width being sized to inhibit or prevent passage of a fuel pellet; and a handle on the pellet tray graspable by a user to introduce or remove the pellet tray into the combustion chamber to adapt the stove to a pellet burning stove.

In some aspects, the pellet adapter may include a raised outer rim around the pellet tray having a first height. In some aspects, the pellet adapter may include a central protuberance extending from the pellet tray with a second height greater than the first height. In some aspects, the handle may be formed as at least one of: an opening in the central protuberance or a graspable handle extending above the pellet tray. In some aspects, the pellet adapter further comprises a plurality of indentations formed in the pellet tray that form legs that offset the pellet tray from the fuel grate.

In yet other implementations, this disclosure is directed to methods of adapting a log or stick burning stove to a pellet burning stove, the log or stick burning stove including a combustion chamber with a fuel grate therein. The fuel grate may have holes configured to pass air or ash therethrough, the holes having a first width that does not inhibit or prevent passage of a fuel pellet. The method may include grasping a pellet adapter by a handle, the pellet adapter having a pellet tray comprising a plurality of ventilation holes having a second width smaller than the first width, the second width being sized to inhibit or prevent passage of a fuel pellet; introducing the pellet adapter into a top opening of the combustion chamber of the log or stick burning stove; and adding fuel pellets onto the pellet tray for combustion.

In some aspects of the method, introducing the pellet adapter into the top opening of the combustion chamber includes placing the pellet adapter onto the fuel grate. The pellet adapter may be offset from the fuel grate to permit air to flow between the fuel grate and the pellet adapter.

This Summary is provided to introduce a selection of concepts in a simplified form that are further described below in the Detailed Description. This Summary is not intended to identify key features or essential features of the claimed subject matter, nor is it intended to limit the scope of the claimed subject matter. A more extensive presentation of features, details, utilities, and advantages of the fuel grate, as defined in the claims, is provided in the following written description of various embodiments of the disclosure and illustrated in the accompanying drawings.

BRIEF DESCRIPTION OF THE DRAWINGS

Illustrative embodiments of the present disclosure will be described with reference to the accompanying drawings, of which.

DETAILED DESCRIPTION

Figure 1:
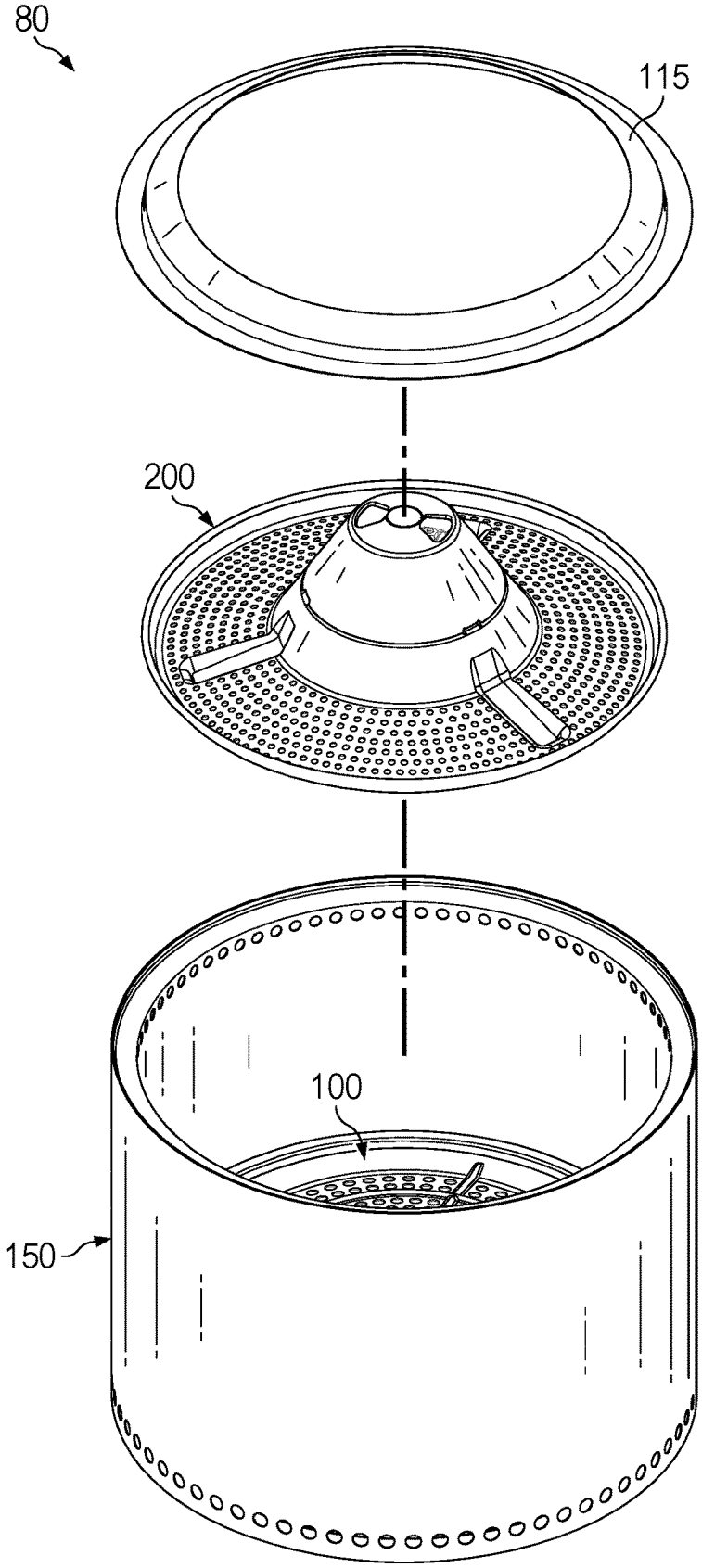
FIG. 1 is a perspective, exploded view of an example combustion stove, such as a wood burning fire pit, in accordance with at least one embodiment of the present disclosure.

A pellet adapter for a wood burning stove is provided which includes novel structural features to allow the pellet adapter to fit on top of a fuel grate that may be permanently or removably installed within the body of the stove. The pellet adapter includes features that prevent pelletized biomass fuels (e.g., wood pellets, paper pellets, wood chips, etc.) from falling through ventilation openings in the fuel grate, and that also provide for even distribution and top-down combustion of the fuel pellets. The disclosed pellet adapter also includes air flow features conducive to thorough combustion of fuel, which leads to greater heat generation and substantially reduced smoke. The design may be readily manufactured as a single piece (e.g., stamped from a sheet metal blank), or assembled from two stamped pieces (thus allowing the pellet adapter to be shipped in a smaller container). These configurations permit the pellet adapter to be placed on top of the fuel grate, without substantially increasing the weight or degrading the airflow of the wood burning stove, while retaining the portability and/or packability of the stove.

Thus, for friends gathered around a stove or fire pit (whether at a campsite, picnic table, tailgate party, backyard, or other setting), the stove or fire pit can, with the addition of the pellet adapter, be easily converted from burning firewood to burning biomass pellets or other pelletized fuel. Pelletized fuel is easily storable and transportable (e.g., in sacks or barrels), and has a high energy density. In addition, features of the stove and pellet adapter provide advantageous airflow that permits long-lasting heat, light, and ambience with very little generation of smoke, thus allowing for repeatably enjoyable outdoor experiences. The stove with pellet adapter may also be advantageous for emergency use in situations when other sources of heat and light are not available.

The pellet adapter includes a ventilated pellet tray, an outer retention rim, and a central protuberance. Together, these features permit an optimal arrangement of biomass pellets for top-down, relatively smokeless combustion. The pellet adapter also includes a plurality of embossed or indented features that can serve as handles, and that can also serve as feet that place the pellet adapter in contact with the fuel grate, while preserving an air gap between the pellet adapter and fuel grate.

For the purposes of promoting an understanding of the principles of the present disclosure, reference will now be made to the embodiments illustrated in the drawings, and specific language will be used to describe the same. It is nevertheless understood that no limitation to the scope of the disclosure is intended. Any alterations and further modifications to the described devices, systems, and methods, and any further application of the principles of the present disclosure are fully contemplated and included within the present disclosure as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately.

These descriptions are provided for exemplary purposes only, and should not be considered to limit the scope of the pellet adapter. Certain features may be added, removed, or modified without departing from the spirit of the claimed subject matter.

FIG. 1 is an exploded view showing a few main components of an example combustion stove system 80, also referred to as a fire pit system, in a partially exploded arrangement. The combustion stove system 80 shown here includes a combustion stove shown here as a fire pit 150, a pellet adapter 200 that removably fits within a combustion chamber 190 of the fire pit 150, and a flame ring 115 that may be disposed on an upper edge of the fire pit 150.

Figure 2:
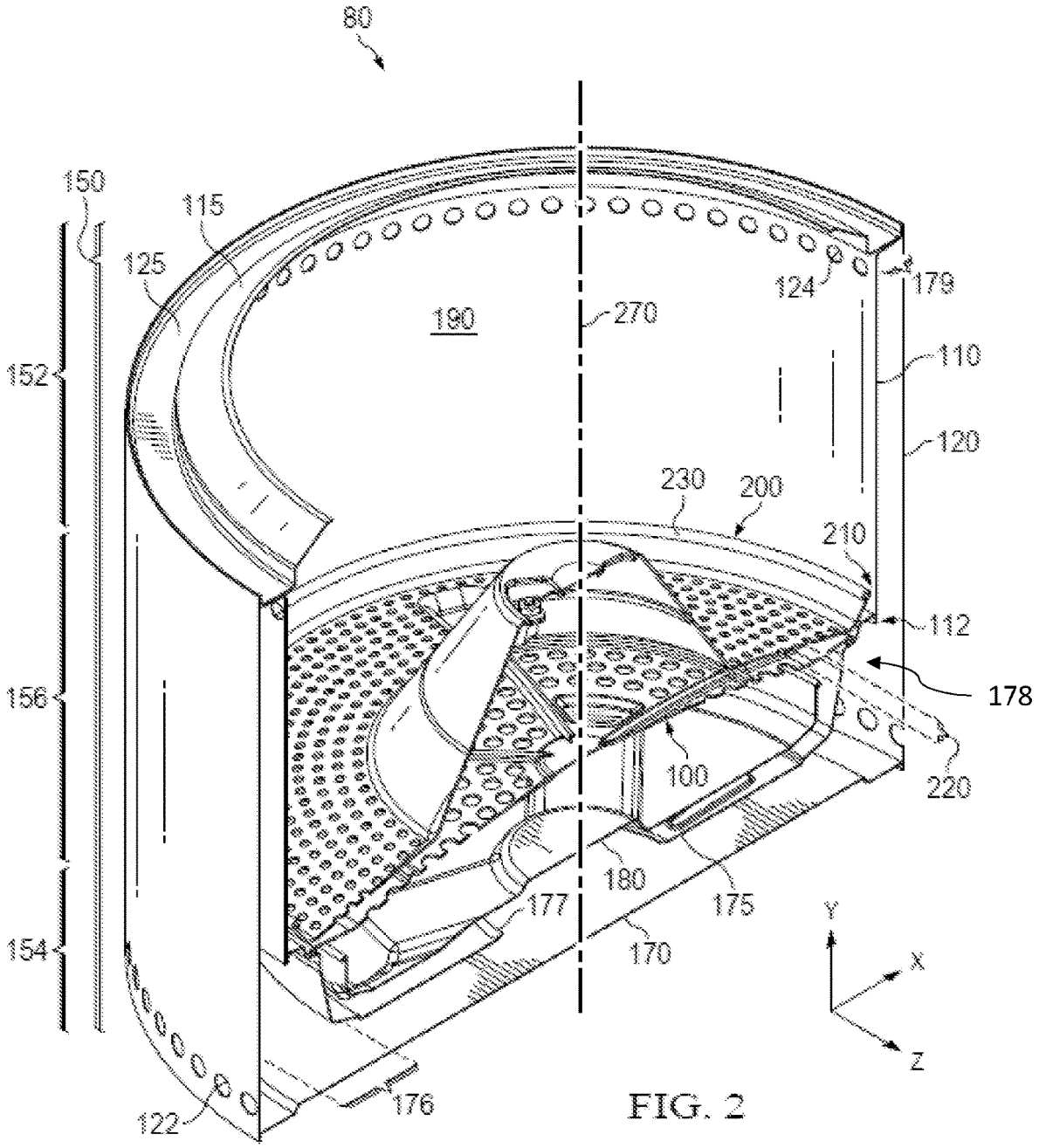
FIG. 2 is a perspective, cross-sectional view of an example combustion stove, such as a wood burning fire pit, including a pellet adapter on top of a fuel grate, in accordance with at least one embodiment of the present disclosure.

FIG. 2 is a perspective, cross-sectional view of the example combustion stove system 80, shown in this example as a wood burning fire pit system with the pellet adapter 200 disposed in the combustion chamber 190. With reference to both FIGS. 1 and 2, the fire pit 150 may include a fire grate or fuel grate 100 disposed within the fire pit 150 and supports the weight of fuel (e.g., wooden logs, sticks, and other fuels) while permitting air flow through the fuel grate 100 and fire pit 150 to facilitate combustion of the fuel. In the implementation shown in FIG. 1, the fuel grate is formed of a sheet of sheet metal having openings therein for the passage of air and ash. The fuel grate 100 is strong and stiff to bear the weight of firewood and other fuel, both at ambient temperatures and at operating temperatures, and at least in part due to its slightly domed shape, may resist substantial warping or other substantial deformation despite prolonged and repeated exposure to the heat of combustion. The fuel grate 100 may also be lighter and have greater airflow than other fuel grates of comparable size.

In the example embodiment of FIG. 2, the fire pit 150 includes a top portion 152, a bottom portion 154, and a middle portion 156. The fire pit 150 further includes an inner wall or inner body 110, an outer wall or outer body 120, a connecting ring 125 located in the top portion 152 of the fire pit 150 and attached to or formed as a single piece with the inner body 110 and/or the outer body 120, and a combustion chamber 190 defined by the inner body 110, within which the fuel grate 100 is positioned on a lip or rollover 112. The fire pit 150 further includes a flame ring 115 that may help drive air-flow toward the central axis 270 when the fire pit 150 is in use. The shape and size of the flame ring may assist with a cleaner burn by directing air in a manner described herein. The fire pit 150 further includes a plurality of outer ventilation holes 122 located in the bottom portion 154 of the outer body 120, and a plurality of inner ventilation holes 124 located in the top portion 152 of the inner body 110. In the middle portion 156 of the fire pit 150, the inner body 110 terminates at a radially inwardly protruding edge that may support an ash pan, and the fuel grate 100.

The fire pit 150 further includes a base plate 170 attached to the outer body 120, a bracing tray 175 supported by stands projecting upward from the base plate or suspended from the inner body 110, and a catch tray or ash pan 180 supported by stands projecting upward from the bracing tray 175 or that may be otherwise suspended from the inner body 110, such that the bracing tray 175 is separated from the outer body 120 by an air gap 176, the ash pan 180 is separated from the outer body 120 by an air gap 178, and the inner body is separated from the outer body by an air gap 179. In an example, air gaps 176 and 179 are both about 50 mm, while air gap 178 is about 100 mm, although other air gaps may be employed that have the disclosed, advantageous effect.

As shown in FIG. 2, the bracing tray 175 includes a ventilation opening 177 that, in the example shown, is centrally disposed, directly under the ash pan 180.

The cavity 190 is in fluid communication with the air gap 179 via the inner ventilation holes 124. The cavity 190 is in fluid communication with air gaps 178 and 176 via the fuel grate 100. The air gaps 176 and 178 are in fluid communication with ambient air via the outer ventilation holes 122, such that ambient air may be drawn in through the outer ventilation holes 122, heated by combustion of the fuel, and expelled through the cavity 190 and inner ventilation holes 124 to produce advantageous combustion of the fuel. In some examples, the fire pit may be similar in some or all respects to the fire pit described in U.S. application Ser. No. 17/169,269, filed Feb. 5, 2021, incorporated herein by reference in its entirety.

In an example, both the fuel grate 100 and other components of the fire pit 150 are made of stainless steel plates having a thickness within a range of between about 0.5 mm and about 2.5 mm thick. Some examples of the fuel grate 100 and other components of the fire pit 150 are formed of 1.0 mm to 2.0 mm thick, and one example is about 1.5 mm thick stainless steel. Both thicker and thinner materials are contemplated. In an example, the fuel grate 100 weighs approximately 48 lb (21.8 kg), although weights of between about 9 oz and about 88 lb may be provided. In an example, during normal operation the fuel grate 100 supports a nominal weight of 100 lb (45.4 kg), (although nominal capacities of between about 5 lb and about 190 lb may be provided), while the fuel grate 100, or portions thereof, are heated to between about 700° F. (371° C.) and about 1350° F. (732° C.) by the combustion of the fuel, for a time period of between 1 and 12 hours, and also at ambient temperatures as low as −40° F. (−40° C.). In an example, during normal operation over a period of years, with repeated cycling (e.g., one hundred cycles) between ambient and operational temperatures, the fuel grate 100 exhibits little or no warping that would detrimentally affect its aesthetic appearance, its performance, or its fit within the fire pit 150.

The primary load carried by the fuel grate 100 is applied downward, in a direction parallel to axis 270, by the weight of the fuel piled on the fuel grate 100, which is supported, directly or indirectly by the bracing tray 175.

When a fire is lit, rising hot air and the absence of oxygen created by the combustion process creates a vacuum at the bottom of the cavity or combustion chamber 190. This vacuum draws oxygen in through the ventilation holes 122 at the bottom portion of the outer wall or outer body 120 and upward into the cavity or combustion chamber 190. More specifically, cool outside air may flow inward through the ventilation holes 122, and then divide to flow upward toward the ventilation holes 124 and laterally inward toward the cavity or combustion chamber 190. The laterally inward flowing air may flow between the bracing tray 175 and the base plate 170, through one or more ventilation openings 177 in the bracing tray 175, and around the bottom of the ash pan 180, upward through the fuel grate 100 and into the cavity or combustion chamber 190 to support direct (primary) combustion of the fuel. In the example shown with the pellet adapter 200 in place for use, the air flows not only through the fuel grate, but also through the pellet adapter to enter the combustion chamber 190. The structure of the pellet adapter 200, including the air-flow openings in the pellet adapter 200, are described further below. The configuration shown in FIGS. 1 and 2 can enable secondary combustion of unburnt volatile organic compounds (VOCs) emitted by the fuel during combustion. This occurs because additional oxygen travels from ventilation holes 122 vertically upward in the gap 179 between the outer wall or outer body 120 and the inner wall or inner body 110, where the oxygen is preheated by the temperature of the inner body 110. The oxygen continues to then flow back into the cavity or combustion chamber 190 through the upper ventilation holes 124, for additional combustion of VOCs within the column of heat and flame rising in the cavity or combustion chamber 190. The flame ring 115 may help funnel the oxygen into the column, thereby creating additional heat and combustion of the VOCs. Such secondary combustion can not only increase heat and light output of the fire pit 150, but also decrease the production of smoke by ensuring a more complete combustion of the fuel.

FIG. 2 shows the pellet adapter 200 disposed on top of the fuel grate 100 in a position for use, in accordance with at least one embodiment of the present disclosure. The pellet adapter 200 is removably positioned on top of the fuel grate 100 within the cavity or combustion chamber 190, such that an air gap 220 is maintained between the fuel grate 100 and pellet adapter 200, and such that some portions or features of the pellet adapter 200 are in contact with, and supported by, the fuel grate 100. In addition, the shape and size of the pellet adapter 200 is such that a raised outer rim or retention rim 230 of the pellet adapter 200 leaves an air gap 210 between the outer rim or retention rim 230 and the inner wall or inner body 110. In some implementations, the pellet adapter 200 may be sized so that the air gap 210 is small enough to inhibit or prevent pellets from falling between the retention rim 230 and the inner wall or inner body 110. In some examples therefore, the air gap 210 is within a range of about 1 to 8 mm. However, air gaps of other sizes are also contemplated. The air gap 210 may also permit some air flow between the pellet adapter 200 and the inner wall or inner body 110, and may also be sized to fit a user's hand or a gripping tool to facilitate gripping of the pellet adapter 200 while the pellet adapter 200 is being lowered into or raised out of the cavity or combustion chamber 190. Thus, the air gap 210 may also provide a clearance that enables the pellet adapter 200 to be easily lifted and removed and easily introduced into the combustion chamber 190.

The addition of the pellet adapter 200 to the fire pit 150 and fuel grate 100 advantageously permits the fire pit 150 to burn biomass pellets instead of firewood, to obtain the above-described advantages of a storable, energy-dense fuel that may combust more uniformly over a longer period of time than firewood, thus providing an extended period of desirable heat, light, and ambience from the fire pit 150, while retaining the advantageous airflow described above in FIG. 2. Although referenced herein as wooden pellets, it is apparent that any biomass pellet may be used.

Figure 3:
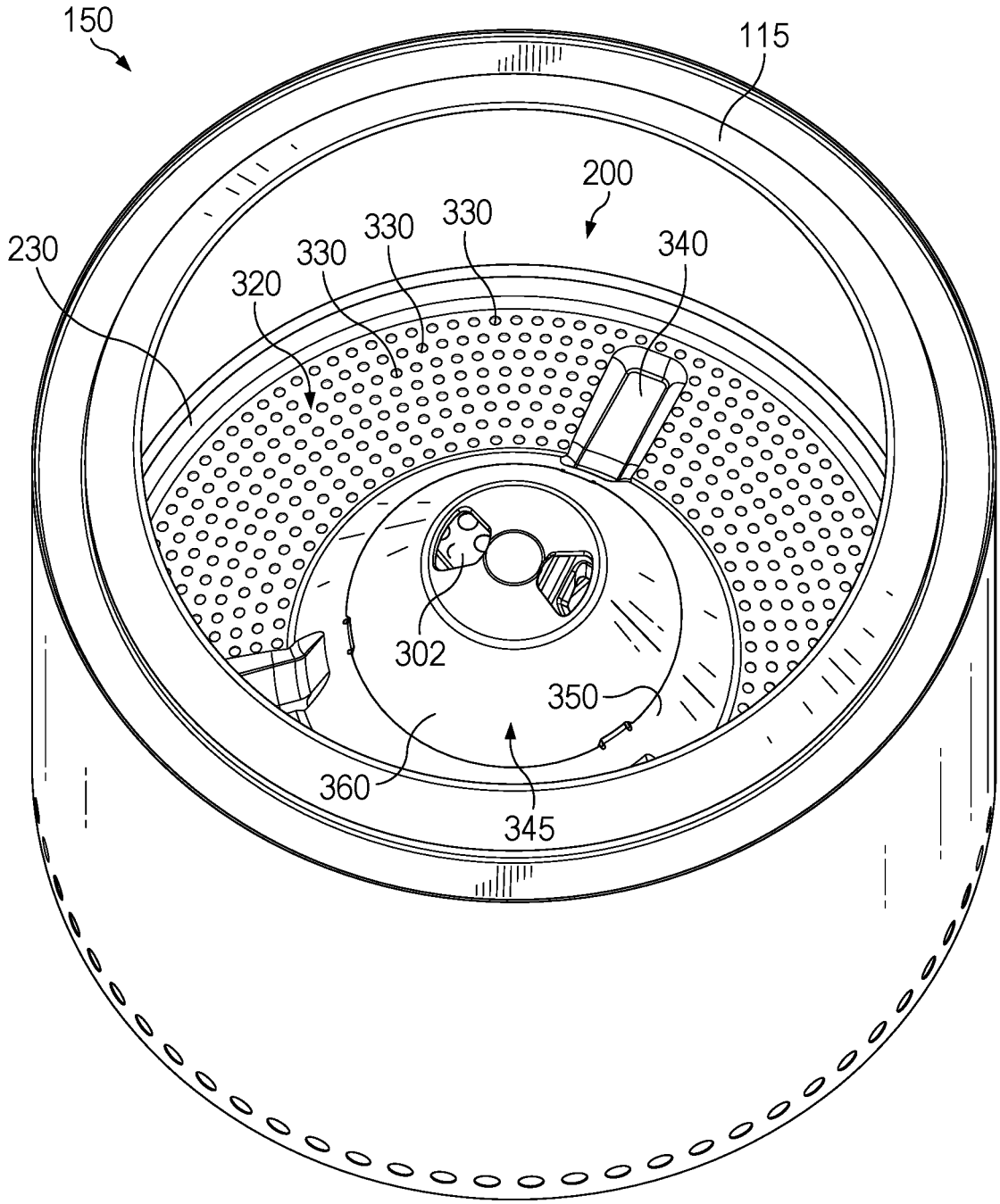
FIG. 3 is a top perspective view of a pellet adapter resting removably within a wood burning stove, in accordance with at least one embodiment of the present disclosure.
Figure 4:
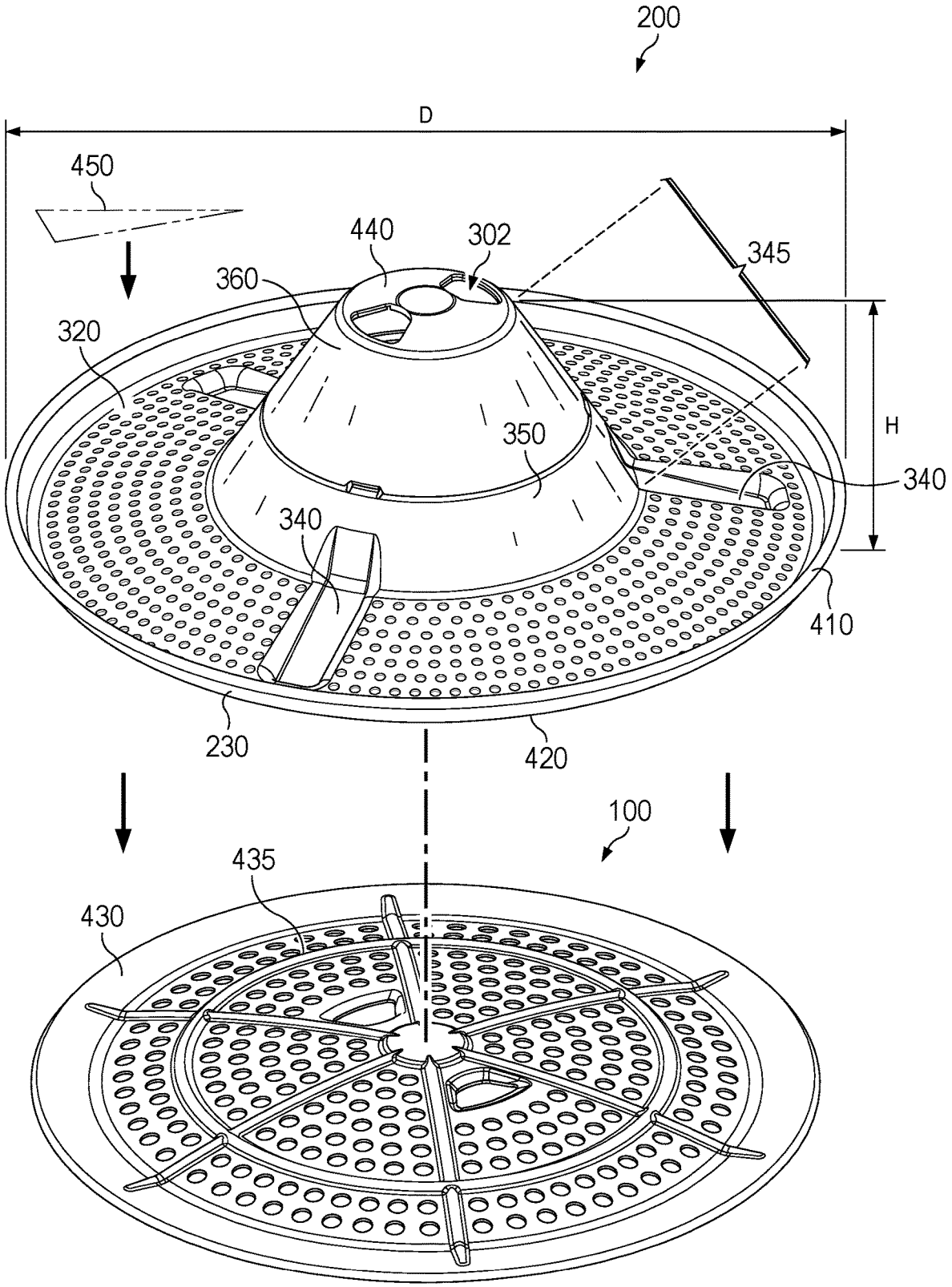
FIG. 4 is an exemplary illustration of a pellet adapter and a fuel grate for a wood burning stove, in accordance with at least one embodiment of the present disclosure.
Figure 5:
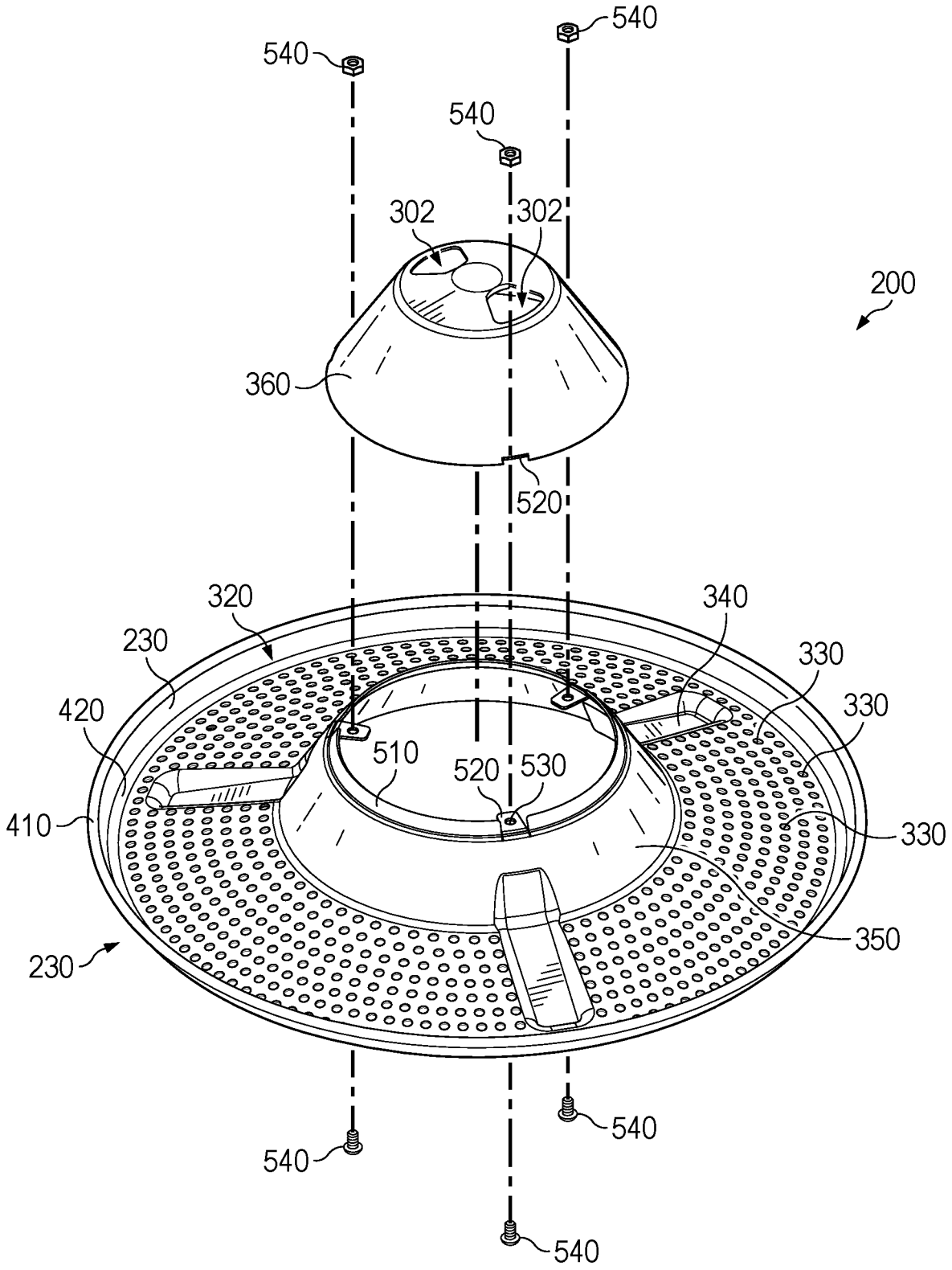
FIG. 5 is a front perspective, exploded view of an exemplary pellet adapter for a wood burning stove, in accordance with at least one embodiment of the present disclosure.

FIGS. 3-5 show the pellet adapter in greater detail. FIG. 3 shows the pellet adapter 200 resting removably within the fire pit 150, FIG. 4 shows the pellet adapter 200 disposed above the fuel grate upon which it may rest when in use, and FIG. 5 shows the pellet adapter 200 in one example of a disassembled state, in accordance with at least one embodiment of the present disclosure.

Referring to FIGS. 3-5, the pellet adapter 200 includes a raised outer rim or pellet retention rim 230 and a pellet tray 320 that includes a plurality of ventilation holes 330. The outer rim or pellet retention rim 230 may for example be part of, or co-formed with, the pellet tray 320, and may advantageously serve to prevent wooden pellets or other fuel from rolling off the sides of the pellet tray 320. The pellet tray 320 also includes a plurality of ventilation holes 330 whose size and shape is selected such that a biomass pellet or similar solid fuel cannot easily fall through the holes. These holes 330 may for example be smaller than the holes in the fuel grate 100 (see FIG. 1). In some examples, the ventilation holes 330 are sized to have a width in a range of about 1 to 5.5 mm, thereby preventing passage of pellets with a width of 6 mm or greater. In some implementations, the ventilation holes 330 are sized to have a width in a range of about 1 to 7.5 mm to prevent passage of pellets with a width of 8 mm or greater. Other sizes are contemplated to accommodate differently sized pellets. In contrast, the ventilation holes in the fuel grate may be sized larger than 8 mm and may permit passage of pellets having a width of 8 mm or smaller.

In order for the pellet adapter 200 to provide similar air flow to the fuel grate 100, the ventilation holes 330 in the pellet tray 320 of the pellet adapter 200 may be more numerous than the ventilation holes in the fuel grate 100, such that the total area of the holes 330 may be similar to the total area of the holes in the fuel grate 100.

In the example shown in FIGS. 3-5, the pellet adapter 200 also includes a plurality of indentations or legs 340 (also referred to as feet) that may, in some embodiments, that extend below the main surface of the pellet tray 320 and cooperate to offset a bottom surface of the pellet tray 320 from the fuel grate 100. This may provide an air passage between the pellet adapter 200 and the fuel grate 100 that enables air flow not just at lateral edges of the pellet adapter 200, but air flow through the fuel grate to all the ventilation holes 330 for a consistent burn. Here, the legs 340 are indentations formed in the pellet tray 320, but in other implementations, the legs 340 may be attached to the pellet tray or otherwise disposed to offset the pellet tray 320 from the fuel grate 100.

The example pellet adapter 200 described herein also includes a handle 302 grippable by a user (e.g., to place the pellet adapter 200 within the fire pit 150, or to remove the pellet adapter 200 from the fire pit 150). Here, the handle 302 is centrally disposed and formed of two openings into which a tool or a user's fingers may fit to grasp the pellet adapter. Other handles are contemplated, however. The handle 302 is disposed at an elevation above the pellet tray 320 so that the handle can be grasped even if pellets are in the pellet tray 320.

In the example shown, the pellet adapter 200 also includes a central protuberance 345 (e.g., a truncated cone) that keeps wooden pellets from stacking at or near the center of the pellet tray 320. This enables easy piling of the wooden pellets in a ring shape around the circumference of the pellet tray 320, which may be an advantageous arrangement for slow, uniform, relatively smokeless combustion. The central protuberance 345 may for example include a bottom portion 350 that may be part of or co-formed with the pellet tray 320, and a top portion 360 that is removably attached to the bottom portion 350. However, in other embodiments, the central protuberance 345 may be a single piece that is removably attached to the pellet tray 320 or may be a single piece that is part of, or co-formed with, the pellet tray 320. The height of the top portion 360 is generally greater than the height of the raised outer rim 230, such that the total height of the pellet adapter 200 is defined by the central protuberance 345 rather than by the outer rim 230. In the example shown, the handle 302 is disposed at the peak of the protuberance 345.

Still referring to FIGS. 3-5, the central protuberance 345 is generally shaped as a truncated cone that is wider on the bottom and narrower on the top. The top portion 360 includes a central hub 440 that may for example be a part of, or co-formed with, the top portion 360. Furthermore, the pellet tray 320 is sloped, such that it also takes the general form of a truncated cone, although one that is shorter, flatter, or shallower than the truncated cone of the central protuberance 345. This arrangement may for example encourage a desirable distribution of fuel pellets, wherein when pellets are poured onto the pellet tray 320 under the influence of gravity, the pellet pile may naturally tend to be deeper near the outer rim 230 of the pellet adapter 200, shallower near the central protuberance 345, and absent on the slopes of the central protuberance. The resulting distribution 450 may for example be approximately wedge-shaped in cross section and approximately toroidal when seen from above, which may encourage greater combustion near the outer retention rim 230 and lesser combustion near the central protuberance 345. It is understood that other sloped shapes for the pellet tray may be used instead or in addition, including domed or pyramidal shapes, while still achieving a favorable distribution as described above. In some examples, the pellet tray may generally match the profile of the fuel grate 100.

In the example shown in FIG. 4, the outer rim 230 includes a top lip or rollover 410 and a bottom edge 420. The top lip or rollover 410 may for example provide a user-friendly edge that is easy to grip, lift raise, lower, etc. In some examples, the bottom edge 420 may for example provide contact with an outer portion 430 of the fuel grate 100 when the pellet adapter 200 is lowered onto the fuel grate 100. Similarly, the indentations or legs 340 may be sized and shaped provide contact with a middle portion 435 and/or outer portion 430 of the fuel grate 100 when the pellet adapter 200 is lowered onto the fuel grate 100. In some examples, the fuel grate 100 includes protrusions upon which the pellet adapter 200 may rest.

The outer retention rim 230, indentations or legs 340, and bottom portion 350 of the central protuberance 345 are features that may for example be stampable from a single sheet metal blank that includes the pellet tray 320. Thus, the structure is lightweight and can be manufactured and shipped at low cost. These features may also add considerable stiffness to the pellet adapter 200, such that it can resist warping or deformation at high operating temperatures and with rapid temperature cycling.

The pellet adapter 200 has an outer diameter D and a total height H, as shown in FIG. 4. The diameter D may be selected such that the pellet adapter 200 fits on top of the fuel grate 100 and within the inner wall or inner body 110 (see FIG. 2), while leaving an air gap 210 between the outer retention rim 230 and the inner body 110 (see FIG. 2). The ratio of D to H may for example be selected based on the diameter D, such that the height H is relatively similar between different stove sizes, whereas the diameter D increases proportionally with an inner diameter of the inner body 110. Thus, a pellet adapter for larger stoves may have a relatively larger ratio of D to H, whereas a pellet adapter for a smaller stove may have a relatively smaller ratio of D to H. This advantageous arrangement may facilitate long, slow, even, and relatively smokeless combustion of biomass pellets and other similar fuels (e.g., wood or paper pellets, wood chips, construction waste, etc.), thus advantageously enabling a long period of consistent heat, light, and ambience from the stove that can increase the comfort and enjoyment of users in a backyard, campsite, outdoor table setting, etc.

Depending on the implementation, the outer diameter D of the pellet adapter 200 may be between 6" and 50", although other diameters, both larger and smaller, may be used instead or in addition. Depending on the implementation, the total height H may be between 4" and 12", although other heights, both larger and smaller, may be used instead or in addition. Example D/H ratios may vary from 0.5 (e.g., for a small stove) to 15.0 (e.g., for a large fire pit), although other ratios, both larger and smaller, may be used instead or in addition.

It is noted that while the fuel grate and pellet adapter are both shown in FIG. 4 as being circular, in other embodiments the stove, fuel grate, and/or pellet adapter may be noncircular, including but not limited to shapes such as triangular, square, rectangular, polygonal, or oval.

Figure 6:
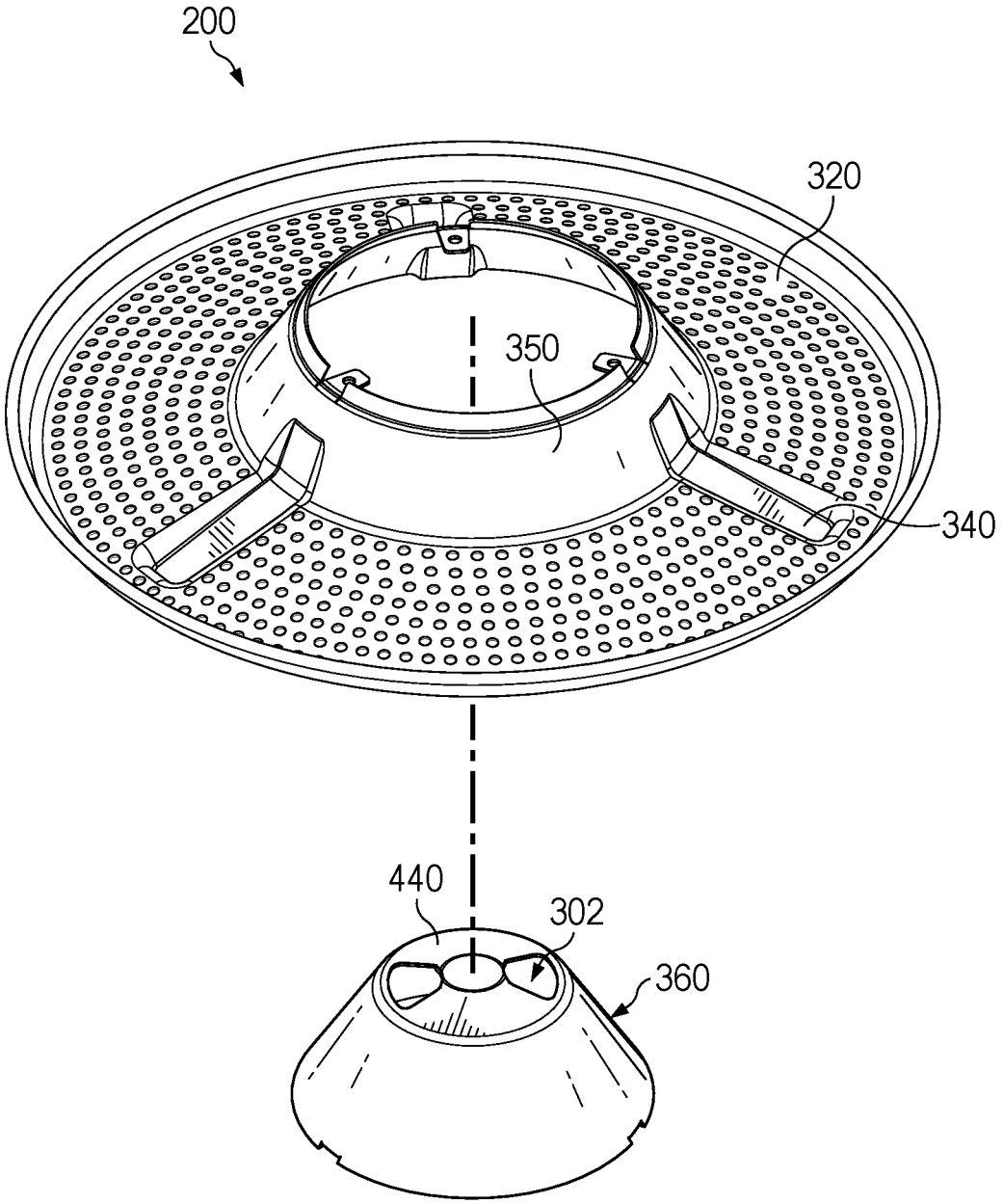
FIG. 6 is a perspective, exploded view of an example pellet adapter in accordance with at least one embodiment of the present disclosure.

FIGS. 5 and 6 show the pellet adapter in an exploded view, in accordance with at least one embodiment of the present disclosure. In the example shown, the top portion 360 is a separate piece from the bottom portion 350 but is removably attachable to the bottom portion 350 by a retention lip 510 and by fasteners 540 that can be fastened through holes 530 in folded tabs 520 in both the bottom portion 350 and top portion 360. By having the central protuberance be separable into a bottom portion 350 and top portion 360, the example pellet adapter of FIG. 5 advantageously allows the pellet adapter 200 to be disassembled. Further, the shape of the bottom portion 350 and the top portion 360 allows the top portion 360 to be introducible into and storable within the bottom portion 350, as shown in FIG. 6. Nesting the top portion 360 in the bottom portion 350 may reduce the overall height H (FIG. 4). This may result in a smaller packing envelope that requires less storage space, less packing space, and a smaller shipping envelope with associated reduction in shipping costs. An end user, a retailer, the manufacturer, or other party may assembly the bottom portion 350 and the top portion 360 using the fasteners described herein or using alternative fasteners. In some embodiments, fasteners 540 are not needed, and the top portion 360 simply rests on top of the bottom portion 350 or is retained on the bottom portion 350 by a friction fit, screw fit, locking fit, or other means. It is noted that in some embodiments, the pellet adapter 200 could comprise more or fewer than two pieces. For example, not including fasteners, the pellet adapter 200 could have one, three, four, or more pieces.

Figure 7:
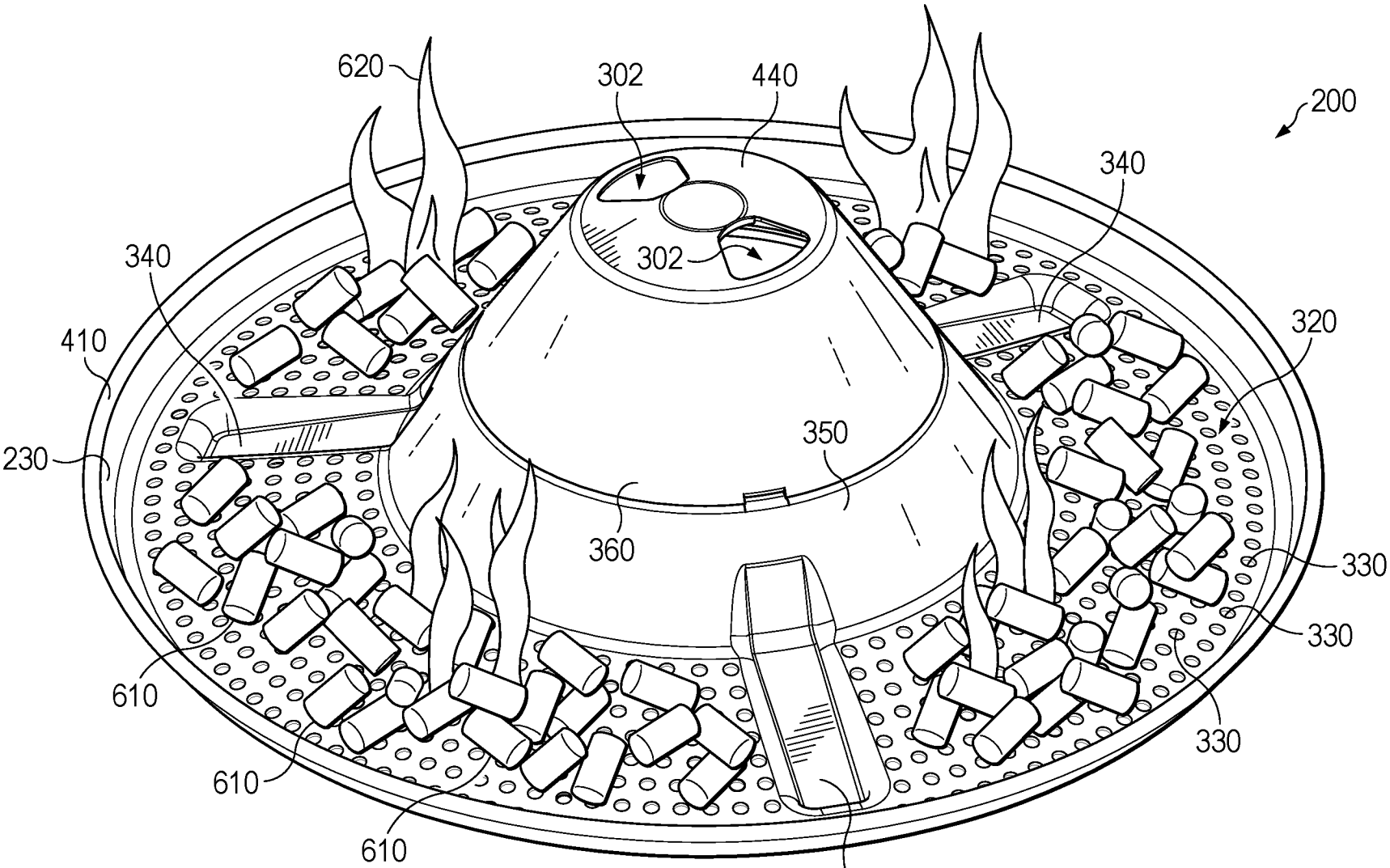
FIG. 7 is a front perspective view of an exemplary pellet adapter for a wood burning stove, in accordance with at least one embodiment of the present disclosure.

FIG. 7 shows the pellet adapter 200 with the top portion 360 and the bottom portion 350 of the central protuberance 345 assembled together, and a plurality of fuel pellets 610 (e.g., wood pellets, paper pellets, wood chips, pelletized waste lumber, etc.) distributed on the pellet tray 320.

Due to the advantageous configuration of the pellet tray 320, outer retention edge 230, bottom portion 350 and top portion 360, the fuel pellets 610 are easily scattered in a distribution that favorably affects combustion, thus allowing for attractive and long-lasting flames 620, with minimal generation of smoke. In addition, in the example shown in FIG. 5, the central hub 440 of the top portion 360 includes the openings of the handle 302 (e.g., two openings, although more or fewer openings can be provided instead or in addition). These openings to the handle 302 can advantageously provide air flow through a central portion of the fuel grate, and up through the bottom portion 350 and top portion 360. This additional airflow may help to promote secondary combustion of uncombusted volatile organic compounds (VOCs) emitted by the fuel pellets 610 during combustion. As described above, such secondary combustion may advantageously increase the output of heat and light while decreasing the output of smoke, thus taking maximum advantage of the energy content of the fuel pellets 610 and creating an environment of both warm temperature and warm firelight ambience for as long as possible for a given mass or volume of fuel. In some embodiments, as described above, the openings to handle 302 may also serve as finger holes, to facilitate gripping, lifting, and lowering of the pellet adapter 200.

Once the fuel pellets have combusted, the resulting ashes or other combustion byproducts can fall through the holes 330 (see FIG. 3) onto the fuel grate 100 (see FIG. 1), or through the fuel grate 100 onto the ash pan 180.

Figure 8:
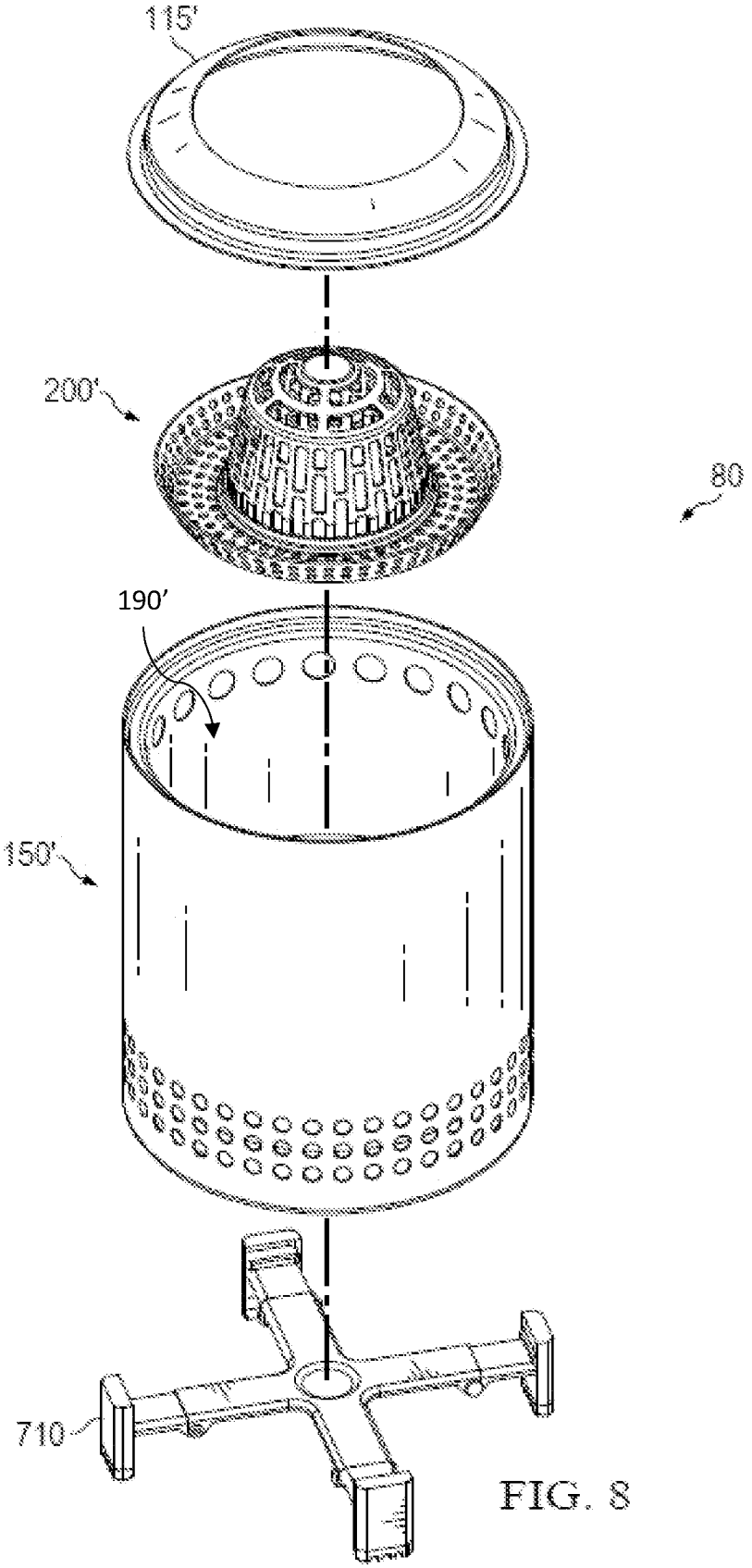
FIG. 8 is a perspective, exploded view of an example tabletop combustion stove, such as a wood burning fire pit, in accordance with at least one embodiment of the present disclosure.

FIG. 8 is an exploded view showing a few main components of an example combustion stove system 80', also referred to as a fire pit system, in a partially exploded arrangement. The combustion stove system 80' shown here includes a combustion stove shown as a fire pit 150', a pellet adapter 200' that removably fits within a combustion chamber 190' of the fire pit 150', and a flame ring 115' that may be disposed on an upper edge of the fire pit 150'. This example also includes a stand 710 upon which the fire pit 150' may rest.

Figure 9:
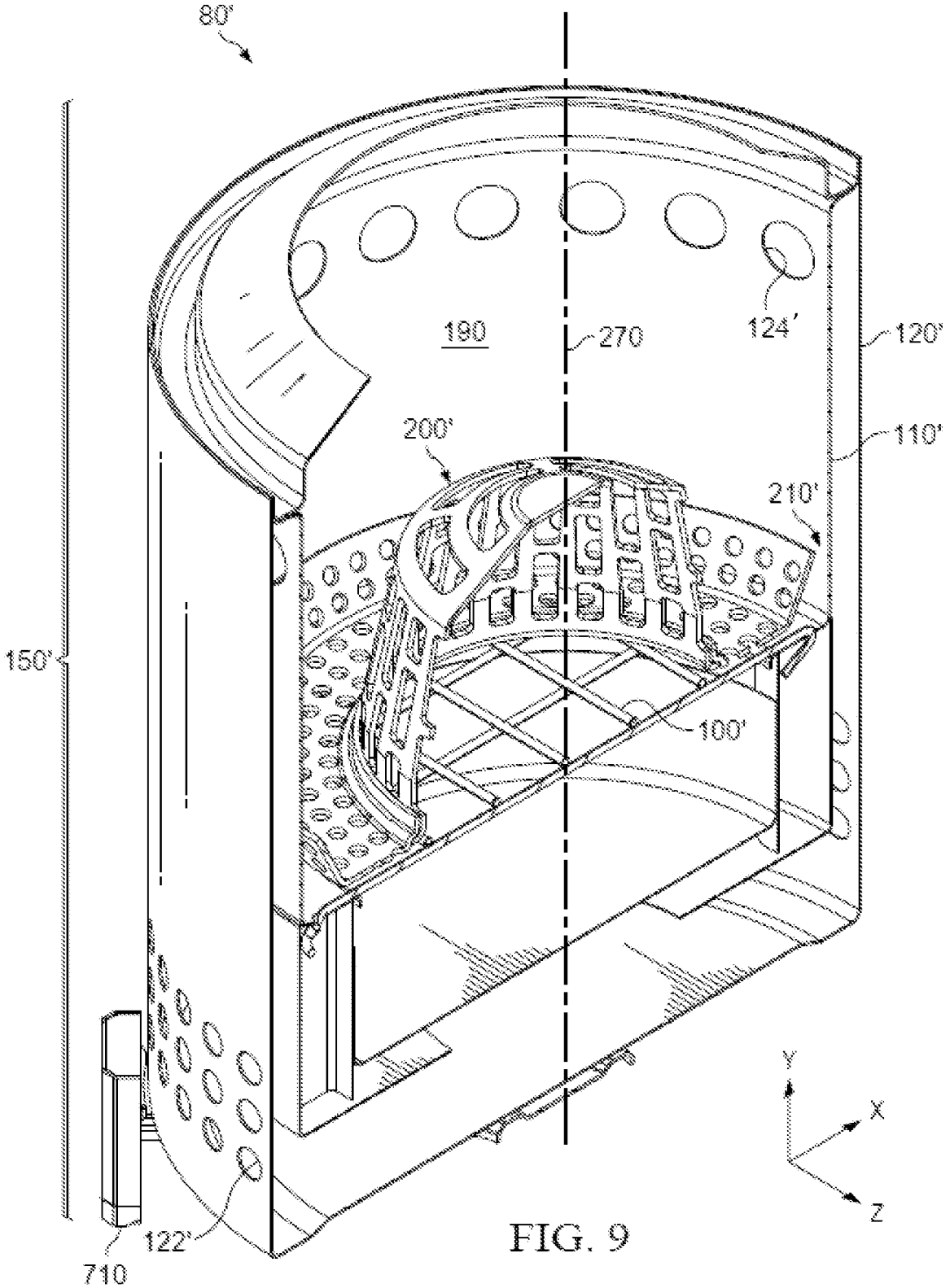
FIG. 9 is a perspective, cross-sectional view of an example tabletop combustion stove, such as a wood burning stove, including a pellet adapter on top of the fuel grate, in accordance with at least one embodiment of the present disclosure.

FIG. 9 shows the combustion stove system 80' with the wood burning fire pit 150', including the pellet adapter 200' on top of a fuel grate 100', in accordance with at least one embodiment of the present disclosure. Like the fire pit 150 described herein, the fire pit 150' includes an inner body 110', an outer wall 120', outer or lower ventilation holes 122', inner or upper ventilation holes 124', a central axis 270, and the fuel grate 100'. In the example shown in FIG. 7, the fire pit 150' is a tabletop fire pit that rests on the stand 710. The stand 710 enables the fire pit 150' to rest on a tabletop or other surface (e.g., a tablecloth, forest floor, etc.) without heating the surface to a dangerous, damaging, or concerning degree. In the embodiment shown, the fuel grate 100 may for example be a flat mesh of welded rod stock that is mostly empty space, with openings far larger than a typical biomass pellet or other fuel pellet. For example, the holes may have a width in a range of about 6-20 mm, though larger and smaller holes are contemplated. However, the pellet adapter 200' fits on top of the fuel grate 100' within the cavity or combustion chamber 190', and is configured to support fuel pellets as shown above with reference to FIG. 7, while permitting advantageous airflow similar to that described above with reference to FIG. 2, as well as secondary combustion as described above. In some examples, the fire pit 150' may be similar in some or all respects to the stove described in U.S. application Ser. No. 17/886,239, filed Aug. 11, 2022, incorporated herein by reference in its entirety. Some reference numbers are reiterated in FIG. 9 that were described earlier, and the description above equally applies to the FIG. 9 embodiment. For example, the description of air gap 210 may apply to air gap 210', and so on.

Figure 10:
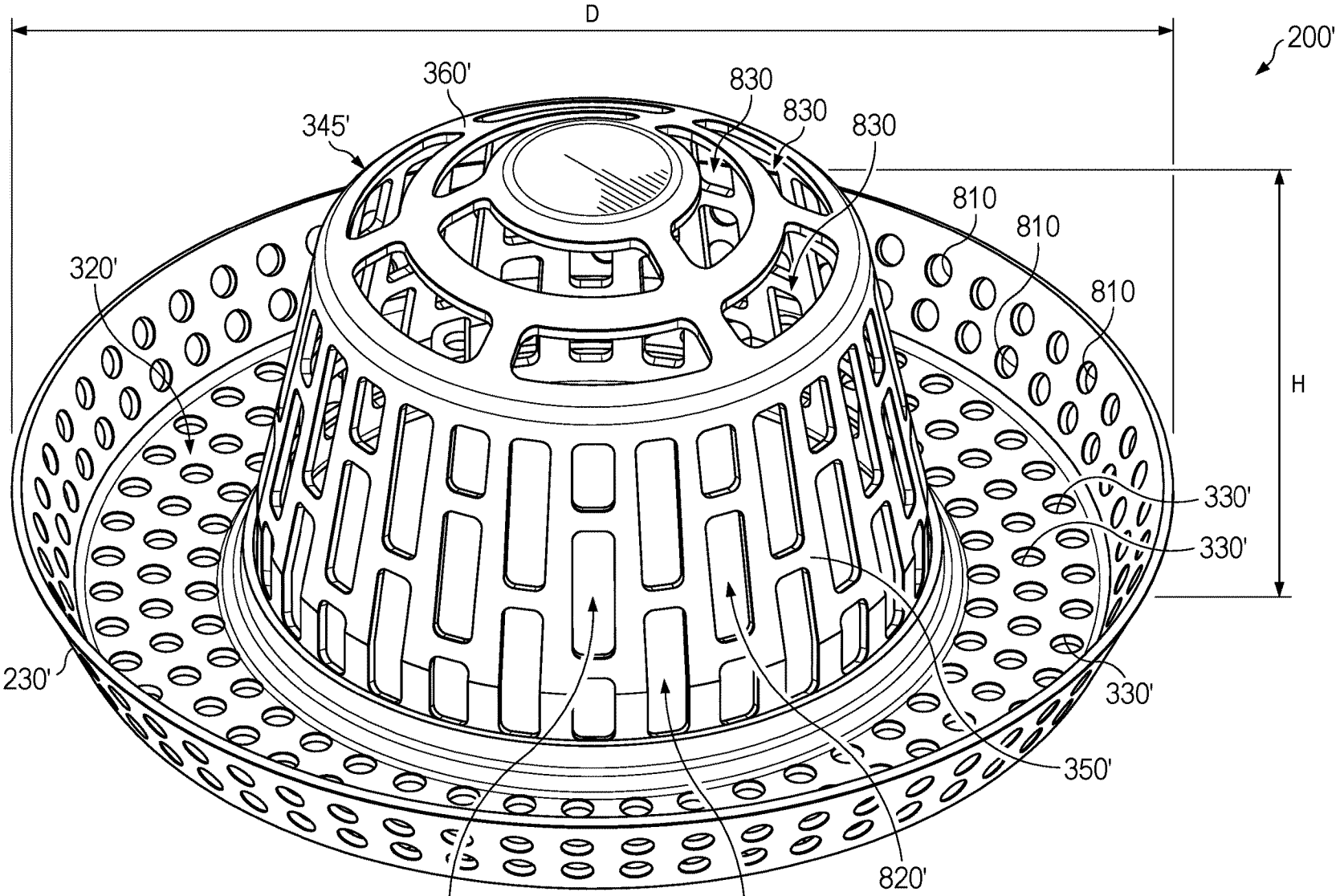
FIG. 10 is a front perspective view of the exemplary pellet adapter of FIG. 7, in accordance with at least one embodiment of the present disclosure.

FIG. 10 is a front perspective view of the exemplary pellet adapter 200' of FIG. 9, in accordance with at least one embodiment of the present disclosure. In the example shown in FIG. 10, the pellet adapter 200' includes a pellet tray 320' that is flat or approximately flat, and the pellet adapter 200' also includes an outer retention rim 230' with ventilation holes 810 similar to the ventilation holes 330 in the pellet tray 320. Furthermore, the pellet adapter 200' also includes a bottom portion 350' of a central protuberance 345' with ventilation openings 820', which may be similar to or different than ventilation openings 330 and 810 described above, but may in any case be sized and shaped so that an uncombusted fuel pellet cannot pass through them. Similarly, a top portion 360' of the central protuberance 345' may include ventilation holes 830, which may be similar to or different than ventilation openings 330 and 810, and sized and shaped to prevent the passage of an uncombusted fuel pellet.

Depending on the implementation, the bottom portion 350' and top portion 360' of the central protuberance 345' may be fixedly attached to one another and to the pellet tray 320'. Because this example pellet adapter 200' is for a small tabletop stove, the ratio of its outer diameter D to its total height H is relatively small.

Figure 11:
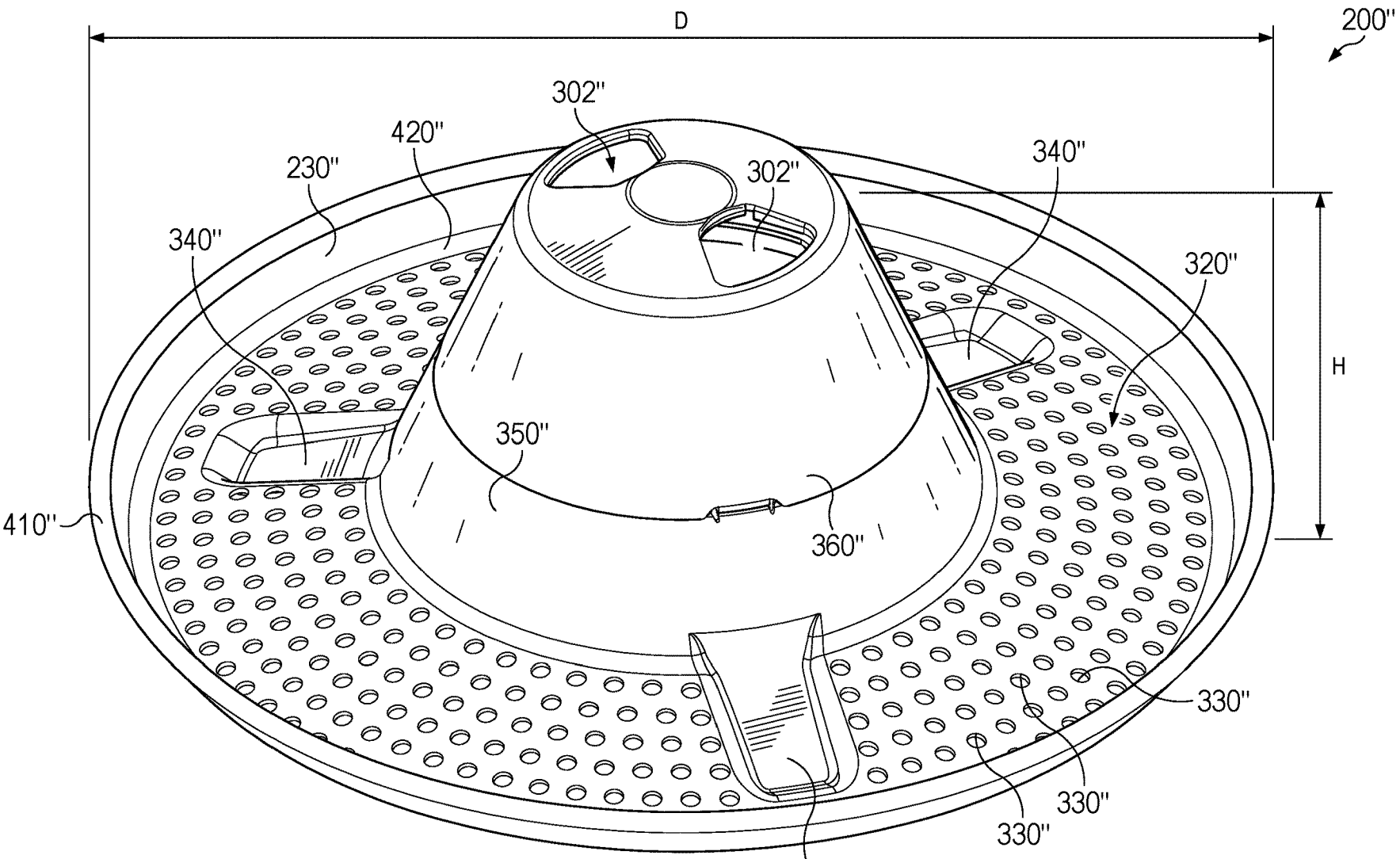
FIG. 11 is a front perspective view of an exemplary pellet adapter for a wood burning stove, in accordance with at least one embodiment of the present disclosure.

FIG. 11 is a front perspective view of an exemplary pellet adapter 200" for a wood burning stove, in accordance with at least one embodiment of the present disclosure. Visible are an outer rim 230", a top lip or rollover 410", a bottom edge 420", a pellet tray 320", indentations (e.g., feet or legs) 340", a bottom portion 350", top portion 360", ventilation holes 330", and ventilation openings formed as handles 302". In the example shown in FIG. 11, the pellet adapter 200" has a moderate ratio of outer diameter D to total height H that may, for example, make it suitable for use in moderately sized wood burning stoves. The description above with reference to the pellet adapter 200 described with reference to FIGS. 1-7 also applies to the pellet adapter 200".

Figure 12:
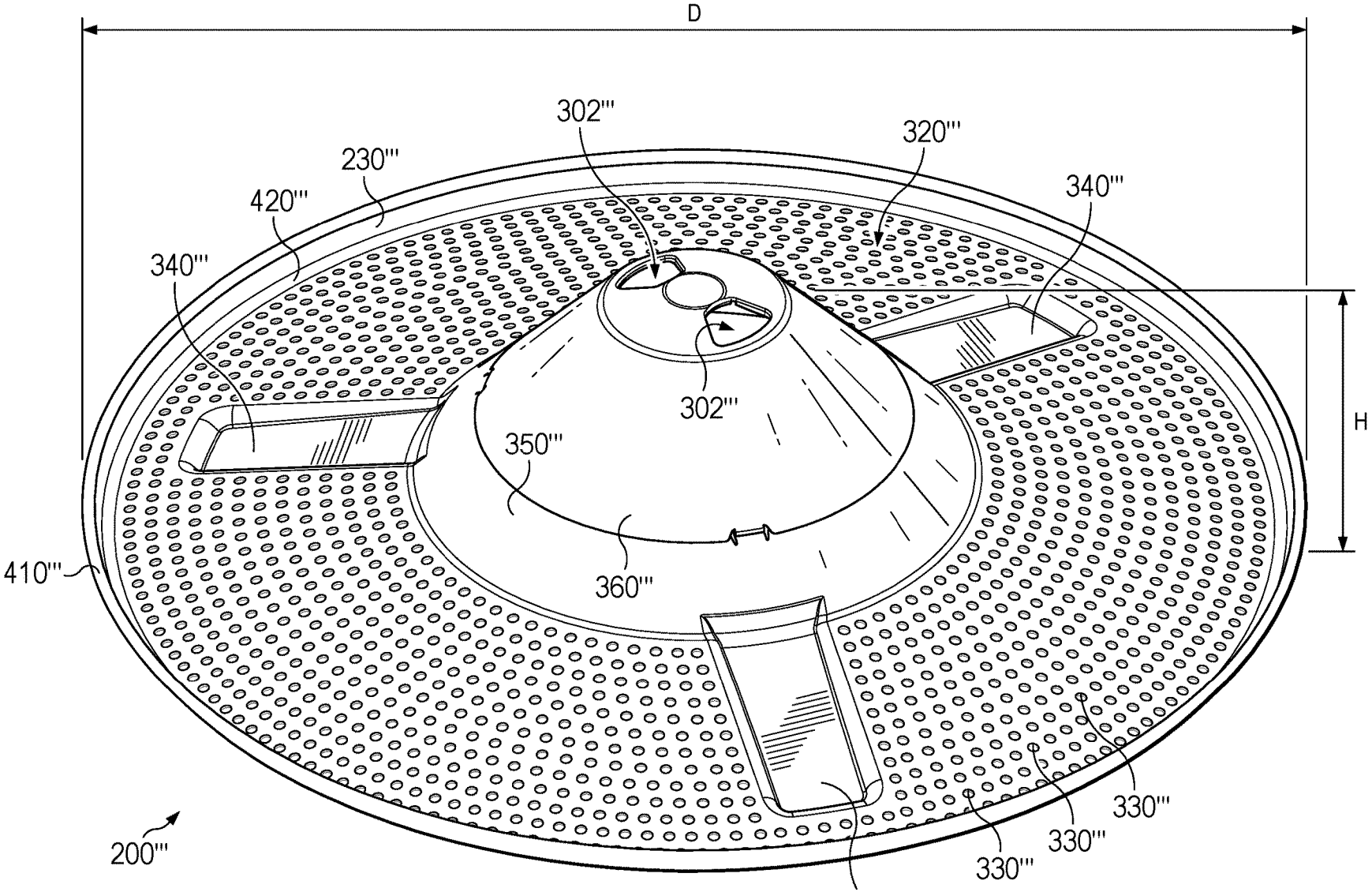
FIG. 12 is a front perspective view of an exemplary pellet adapter for a wood burning stove, in accordance with at least one embodiment of the present disclosure.

FIG. 12 is a front perspective view of an exemplary pellet adapter 200'" for a wood burning stove, in accordance with at least one embodiment of the present disclosure. Visible are the outer rim 230'", top lip or rollover 410'", bottom edge 420'", pellet tray 320'", indentations (e.g., feet or legs) 340'", bottom portion 350'", top portion 360'", ventilation holes 330'", and ventilation openings formed as handles 302'". In the example shown in FIG. 12, the pellet adapter 200 has a larger ratio of outer diameter D to total height H that may, for example, make it suitable for use in larger sized wood burning stoves or small fire pits. The description above with reference to the pellet adapter 200 described with reference to FIGS. 1-7 also applies to the pellet adapter 200'".

Figure 13:
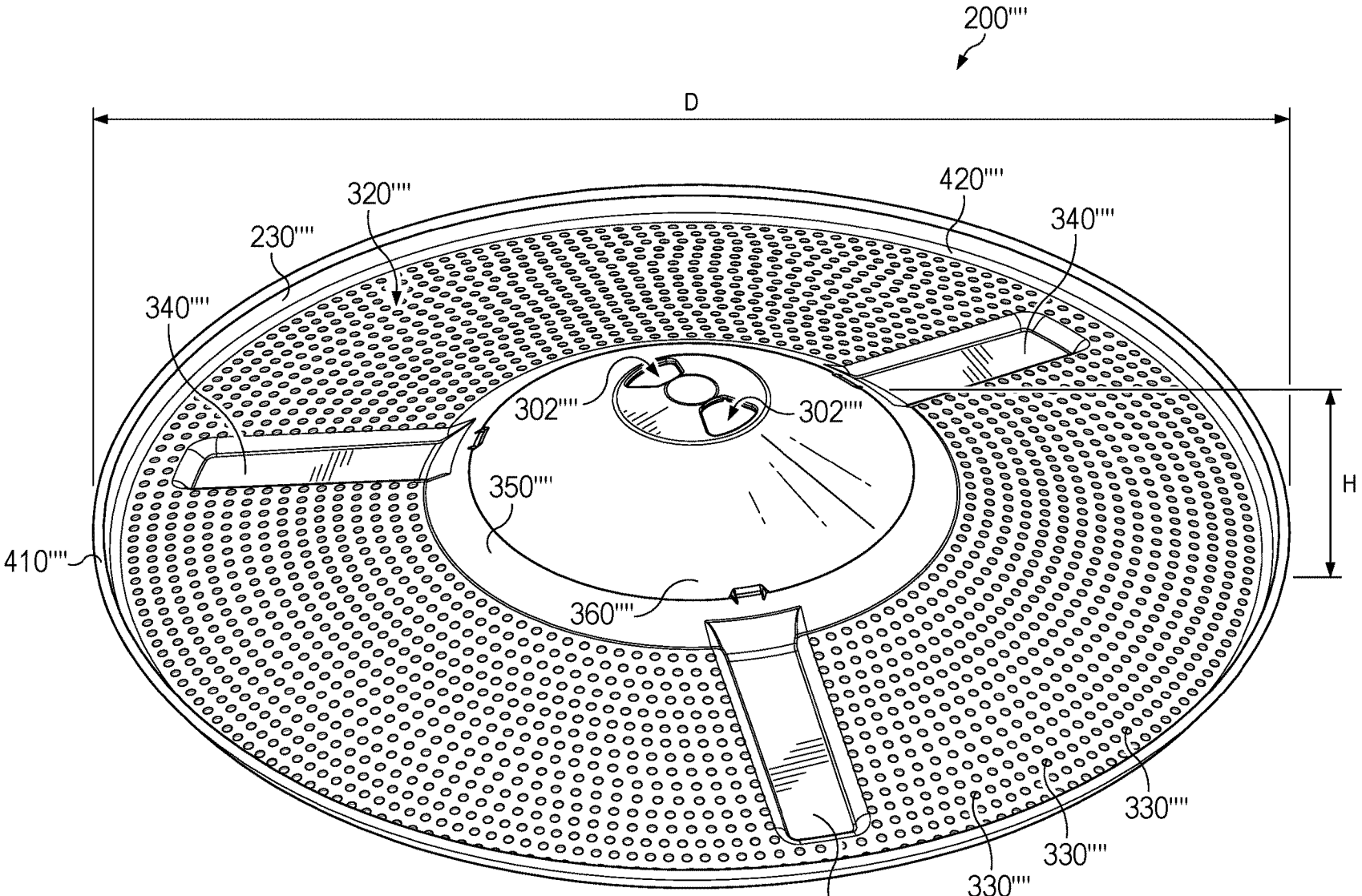
FIG. 13 is a front perspective view of an exemplary pellet adapter for a wood burning stove, in accordance with at least one embodiment of the present disclosure.

FIG. 13 is a front perspective view of an exemplary pellet adapter 200"" for a wood burning stove, in accordance with at least one embodiment of the present disclosure. Visible are the outer rim 230"", top lip or rollover 410"", bottom edge 420"", pellet tray 320"", indentations (e.g., feet or legs) 340"", bottom portion 350"", top portion 360"", ventilation holes 330"", and ventilation openings formed as handles 302"". In the example shown in FIG. 10, the pellet adapter 200 has a large ratio of outer diameter D to total height H that may, for example, make it suitable for use in large fire pits. The description above with reference to the pellet adapter 200 described with reference to FIGS. 1-7 also applies to the pellet adapter 200'".

In use, a user may adapt or convert a log or stick burning stove, such as a fire pit, to a pellet burning stove. The log or stick burning stove may include a combustion chamber with a fuel grate therein. The fuel grate may have holes configured to pass air or ash therethrough, the holes having a first width that does not inhibit or prevent passage of a fuel pellet. The method may include grasping a pellet adapter by a handle, the pellet adapter having a pellet tray comprising a plurality of ventilation holes having a second width smaller than the first width, the second width being sized to inhibit or prevent passage of a fuel pellet; introducing the pellet adapter into a top opening of the combustion chamber of the log or stick burning stove; and adding fuel pellets onto the pellet tray for combustion.

In some aspects of the method, introducing the pellet adapter into the top opening of the combustion chamber includes placing the pellet adapter onto the fuel grate. The pellet adapter may be offset from the fuel grate to permit air to flow between the fuel grate and the pellet adapter.

A user may adapt or convert the pellet-burning stove, such as a fire pit, back to a log or stick burning stove, by reversing the process above, by grasping the handle and lifting or raising the pellet adapter vertically through the combustion chamber and its opening from a position in the combustion chamber to a position outside the combustion chamber.

Accordingly, it can be seen that the pellet adapters described herein fill a long-standing need in the art, by providing a low-cost, lightweight, stampable, high-strength, high-stiffness, high-airflow structure that permits a normal wood-burning stove or fire pit to function, without modification, as a pellet-burning stove. This permits the stove or fire pit to make use of the portability, storability, and high energy density of pelletized fuels, with consequent advantages in versatility, heat and light output, and ambience.

A number of variations are possible on the examples and embodiments described hereinabove. For example, the pellet adapter could be made of heavier-gauge material in order to support more weight, or of lighter gauge material in order to become lighter and more portable. The pellet adapter could be made in different sizes and/or with different degrees of curvature. The relative lengths, widths, and radii of different components could be different than presented herein. The pellet adapter could be made by different processes, including casting, forging, sintering, milling, or 3D printing. It could be made of different metals, or of nonmetallic materials such as ceramics. The outer rim could be noncircular, including such possible shapes as ovals, rectangles, triangles, and rhombuses. The technology described herein may be used to burn firewood, wood chips or pellets, scrap lumber, paper, cardboard, coal, and other combustible materials. It may be employed for example in lamps, stoves, fire pits, fireplaces, furnaces, forges, and boilers, and other combustion heaters. In some implementations, more than one pellet adapter may be used, or the pellet adapter may comprise several pieces that collectively form a structure like that described herein.

The logical operations making up the embodiments of the technology described herein are referred to variously as operations, steps, objects, elements, components, or modules. Furthermore, it should be understood that these may be performed in any order, unless explicitly claimed otherwise or a specific order is inherently necessitated by the claim language.

All directional references e.g., upper, lower, inner, outer, upward, downward, left, right, lateral, front, back, top, bottom, above, below, vertical, horizontal, clockwise, counterclockwise, proximal, and distal are only used for identification purposes to aid the reader's understanding of the claimed subject matter, and do not create limitations, particularly as to the position, orientation, or use of the fuel grate. Connection references, e.g., attached, coupled, connected, and joined are to be construed broadly and may include intermediate members between a collection of elements and relative movement between elements unless otherwise indicated. As such, connection references do not necessarily imply that two elements are directly connected and in fixed relation to each other. The term "or" shall be interpreted to mean "and/or" rather than "exclusive or." Unless otherwise noted in the claims, stated values shall be interpreted as illustrative only and shall not be taken to be limiting.

The above specification, examples and data provide a complete description of the structure and use of exemplary embodiments of the pellet adapter as defined in the claims. Although various embodiments of the claimed subject matter have been described above with a certain degree of particularity, or with reference to one or more individual embodiments, those skilled in the art could make numerous alterations to the disclosed embodiments without departing from the spirit or scope of the claimed subject matter. Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

What is claimed is:

1. A fire pit comprising:

a combustion chamber;

a fuel grate positioned within the combustion chamber, the fuel grate comprising a plurality of first ventilation holes of a size that permits passage of a fuel chip or fuel pellet;

a pellet adapter removably positionable on the fuel grate within the combustion chamber, the pellet adapter comprising:

a pellet tray comprising a plurality of second ventilation holes sized and shaped to prevent passage of the fuel chip or fuel pellet; and a central protuberance protruding from the pellet tray with a height greater than an outer rim of the pellet tray.

2. The fire pit of claim 1, wherein the pellet adapter further comprises a plurality of indentations.

3. The fire pit of claim 2, wherein the indentations comprise a handle grippable by a user.

4. The fire pit of claim 2, wherein the indentations comprise feet that contact the fuel grate when the pellet adapter is positioned on the fuel grate within the combustion chamber.

5. The fire pit of claim 2, wherein when the pellet adapter is positioned on the fuel grate within the combustion chamber, a bottom edge of the pellet tray contacts the fuel grate.

6. The fire pit of claim 1, wherein the central protuberance comprises a lower portion fixedly attached to the pellet tray and an upper portion removably attached to the lower portion.

7. The fire pit of claim 1, wherein the central protuberance comprises a plurality of third ventilation holes sized and shaped to prevent passage of the fuel chip or fuel pellet.

8. The fire pit of claim 1, wherein the central protuberance comprises a truncated cone.

9. The fire pit of claim 1, wherein the pellet tray comprises a truncated cone.

10. The fire pit of claim 1, wherein the outer rim of the pellet tray comprises a plurality of fourth ventilation holes sized and shaped to prevent passage of the fuel chip or fuel pellet.

11. The fire pit of claim 1, wherein, when the pellet adapter is positioned on the fuel grate within the combustion chamber, an air gap exists between the pellet tray and an inner wall of the combustion chamber.

12. A pellet adapter for adapting a wood burning fire pit to a pellet burning fire pit, the pellet adapter comprising:

a pellet tray comprising a plurality of ventilation holes sized and shaped to prevent passage of a fuel chip or fuel pellet; and a raised outer rim, wherein the pellet adapter is removably positionable on a fuel grate of a fire pit within a combustion chamber of the fire pit.

13. The pellet adapter of claim 12, wherein the pellet adapter further comprises a plurality of indentations formed in the pellet tray.

14. The pellet adapter of claim 13, wherein the indentations comprise feet that contact the fuel grate when the pellet adapter is positioned on the fuel grate within the combustion chamber.

15. The pellet adapter of claim 12, wherein the raised outer rim comprises a plurality of third ventilation holes sized and shaped to prevent passage of the fuel chip or fuel pellet.

16. The pellet adapter of claim 12, wherein the pellet tray comprises a truncated cone.

17. The pellet adapter of claim 12, wherein, when the pellet adapter is positioned on the fuel grate within the combustion chamber, an air gap exists between the raised outer rim and an inner wall of the combustion chamber, and a bottom edge of the raised outer rim contacts the fuel grate.

18. A pellet adapter for adapting a log or stick burning fire pit to a pellet burning fire pit, the log or stick burning fire pit including a combustion chamber with a fuel grate therein, the fuel grate having holes configured to pass air or ash therethrough, the holes having a first width that does not inhibit or prevent passage of a fuel chip or fuel pellet, the pellet adapter comprising:

a pellet tray sized to removably fit within the combustion chamber and comprising a plurality of ventilation holes having a second width smaller than the first width, the second width being sized to inhibit or prevent passage of the fuel chip or fuel pellet.

19. The pellet adapter of claim 18, comprising:

a raised outer rim around the pellet tray having a first height; and a central protuberance extending from the pellet tray with a second height greater than the first height.

20. The pellet adapter of claim 18, wherein the pellet adapter further comprises a plurality of indentations formed in the pellet tray that form legs that offset the pellet tray from the fuel grate.

21. A method of adapting a log or stick burning fire pit to a pellet burning fire pit, the log or stick burning fire pit including a combustion chamber with a fuel grate therein, the fuel grate having holes configured to pass air or ash therethrough, the holes having a first width that does not inhibit or prevent passage of a fuel chip or fuel pellet, the method comprising:

grasping a pellet adapter by a handle, the pellet adapter sized to fit within the combustion chamber and comprising a plurality of ventilation holes having a second width smaller than the first width, the second width being sized to inhibit or prevent passage of the fuel chip or fuel pellet;

introducing the pellet adapter into a top opening of the combustion chamber of the log or stick burning fire pit; and adding fuel chips or fuel pellets onto the pellet adapter for combustion.

22. The method of claim 21, wherein introducing the pellet adapter into a top opening of the combustion chamber includes placing the pellet adapter onto the fuel grate, the pellet adapter being offset from the fuel grate to permit air to flow between the fuel grate and the pellet adapter.

* * * * *